US005118908A

United States Patent [19]

Bolender

[11] Patent Number: 5,118,908

[45] Date of Patent: Jun. 2, 1992

[54] GAS DAMPED DECELERATION SWITCH

[75] Inventor: Robert J. Bolender, Pasadena, Calif.

[73] Assignee: TRW Technar Inc., Irwindale, Calif.

[21] Appl. No.: 609,715

[22] Filed: Nov. 6, 1990

[51] Int. Cl.[5] ..... H01H 35/14

[52] U.S. Cl. ..... 200/61.45 R; 200/61.53

[58] Field of Search ..... 200/61.45 R, 61.53; 307/121

[56] References Cited

U.S. PATENT DOCUMENTS

| | | | |
|---|---|---|---|
| 3,372,372 | 3/1968 | Carpenter et al. | 340/467 |
| 4,191,869 | 3/1980 | Tanaka et al. | 200/61.45 R |
| 4,337,402 | 6/1982 | Nowakowski | 307/121 |
| 4,536,629 | 8/1985 | Diller | 200/61.45 R |
| 4,885,439 | 12/1989 | Otsubo | 200/61.45 R |
| 4,929,805 | 5/1990 | Otsubo | 200/61.45 R |
| 5,017,743 | 5/1991 | Gunning et al. | 200/61.45 R |

*Primary Examiner*—J. R. Scott

*Attorney, Agent, or Firm*—Tarolli, Sundheim & Covell

[57] ABSTRACT

A gas damped deceleration sensor for a vehicle includes a flat spring which is coaxially connected to a mass and which resists movement of the mass in response to deceleration. A preload ring is axially movable against symmetrically located surface areas of the spring to adjust the force of the spring evenly. A second flat spring is connected to the mass at a position axially spaced from the first flat spring to stabilize the mass against deceleration forces acting in directions transverse to the axis.

20 Claims, 5 Drawing Sheets

GAS DAMPED DECELERATION SWITCH

FIELD OF THE INVENTION

The present invention relates to a deceleration switch, and particularly relates to a gas damped deceleration switch which responds to sudden deceleration of a vehicle to activate a vehicle occupant safety device such as an inflatable airbag.

BACKGROUND OF THE INVENTION

U.S. Pat. No. 4,536,629 discloses a gas damped deceleration switch having a mass assembly supported in a housing for movement in response to deceleration. The mass assembly is spring biased into a rest position, and is movable against the bias of the spring toward an electrical contact. The electrical contact is movable by the mass assembly to close an electrical circuit to energize an airbag inflator.

The mass assembly comprises a mass and a damping member attached to the mass. The mass is a rod-shaped member having forward and rear ends, and is supported for longitudinal movement in the housing. The damping member is a disk carried coaxially on the mass. Air in the housing exerts a damping force against the damping member when the damping member moves with the mass. The spring is a spiral spring, and is connected to the mass at a position adjacent to the forward end of the mass. The rear end of the mass is supported in a bore formed in the rear wall of the housing, and is slidably movable in the bore. When the deceleration switch experiences a deceleration pulse, the mass assembly moves against the damping force, as well as against the bias of the spiral spring, away from the rest position. If the deceleration pulse is of sufficient magnitude and duration, the moving mass assembly will reach the electrical contact and will move the electrical contact to close the electrical circuit. The airbag inflator will then be energized.

Operation of the deceleration switch can be adjusted by a pair of set screws. Each one of the two set screws is movable axially against a respective one of two spiral arms of the spring to adjust the initial position of the respective spiral arm of the spring when the mass assembly is in the rest position. The set screws thereby apply and adjust separate preloading forces on the spring.

SUMMARY OF THE INVENTION

In accordance with the present invention, a deceleration switch includes a housing having an axis, and a mass assembly supported for inertial movement along the axis in response to deceleration. The deceleration switch also includes a spring means for exerting an axial force resisting movement of the mass assembly along the axis. The spring means comprises spring members having surface areas in positions which are symmetrical with respect to the axis. An adjustable member has contact surfaces engaged with the symmetrical surface areas of the spring members. A supporting means supports the adjustable member for movement along the axis. Movement of the adjustable member along the axis moves each of the contact surfaces equally against each respective surface area of the spring members.

The gas damped deceleration switch in accordance with the present invention enables precise adjustment of the force exerted on the mass assembly by the spring means. Unlike separately adjustable set screws in the prior art, the single adjustable member in accordance with the invention moves equally against symmetrically located surface areas of the spring members. The effect of the adjustable member on the spring members is uniformly distributed with respect to the axis so that each adjustment to the preloading force of the spring members is automatically balanced with respect to the axis. Since each adjustment to the preloading force of the spring members is automatically balanced, there is no need to perform a balancing function in the adjustment process. Only the amount of movement of the adjustable member needs to be carefully controlled for precise adjustment of the spring means.

In accordance with a preferred embodiment of the invention, the adjustable member is a ring having a circular rim surface extending around the axis, and the contact surfaces are circumferentially spaced portions of the rim surface. The housing also contains a stationary base which has threads extending around the axis. The ring has threads engaged with the threads on the base so that rotation of the ring relative to the base moves the ring along the axis. The spring members preferably are radially extending arms of a flat sheet metal spring. The force exerted by the spring members on the mass assembly is increased by turning the ring to rotate relative to the base so that axial movement of the rim surface increases the deflection of the engaged spring member surfaces. The force exerted by the spring members on the mass assembly is decreased by turning the ring to rotate in the opposite direction relative to the base so that axial movement of the rim surface permits the engaged spring member surfaces to flex back into less deflected positions.

In accordance with another feature of the invention, a deceleration switch comprises a housing having an axis, a mass assembly supported for movement along the axis in response to deceleration, and a spring means for exerting an axial force resisting movement of the mass assembly along the axis. The mass assembly includes a mass and a damping member. The spring means comprises a first spring and a second spring. The first and second springs each have a connection to the housing and a connection to the mass assembly. The two springs resist transverse force components of a deceleration pulse which urge the mass assembly to shift transversely out of its axially centered position. Consistent operation of the deceleration switch is obtained because the mass assembly consistently moves only in a predominantly axial direction regardless of the predominant direction of a deceleration pulse experienced by the vehicle. In a preferred embodiment, the springs are connected to the housing through a base structure supported in the housing. The springs are connected to the mass assembly at spaced apart locations on opposite axial sides of the center of mass of the mass assembly. This arrangement of the springs restrains the mass assembly against rotational movement about its center of mass in response to transverse force components of a deceleration pulse.

In accordance with yet another feature of the invention, a gas damped deceleration switch comprises an electrical contact element and a mass assembly. The mass assembly is supported for movement into contact with the electrical contact element in response to deceleration. A spring means exerts a force resisting movement of the mass assembly. The spring means comprises two electrically conductive springs each having a portion connected to the mass assembly for movement with the mass assembly, and each having a portion anchored in the deceleration switch. The mass assembly, when either in or out of the actuated position, provides a conductive bridge between the two springs for electrical current to flow in a first path extending through the two springs. The mass assembly, when moved into the actuated position, provides a conductive bridge between one spring and the electrical contact element for electrical current to flow in a second path extending through the one spring and the electrical contact element. Preferably, the first current path extending through the two springs further extends through a resistor which limits the current flow along that path to a predetermined level. The deceleration switch thus includes a low-level diagnostic current path extending through the two springs, the resistor and the electrical contact element, and includes a relatively high-level actuating current path through the one spring and the electrical contact element. The actuating current path can carry a relatively high level of current for actuating a vehicle occupant safety device associated with the deceleration switch.

BRIEF DESCRIPTION OF THE DRAWINGS

The features described above, as well as other features of the invention, will become apparent to those skilled in the art to which the invention relates upon reading the following description of a preferred embodiment of the invention in view of the accompanying drawings wherein.

DESCRIPTION OF A PREFERRED EMBODIMENT

In accordance with a preferred embodiment of the present invention, a deceleration switch comprises a housing 10 containing a mass assembly 12. The mass assembly 12 is supported for inertial movement in the housing 10 in response to deceleration. The mass assembly 12 is movable from a rest position to an actuated position in which the mass assembly 12 touches an electrical contact 13 to complete an electrical circuit. The electrical circuit can be associated with a vehicle occupant safety device such as an airbag inflator to actuate the inflator when the circuit is completed.

Structure

Figure 1:
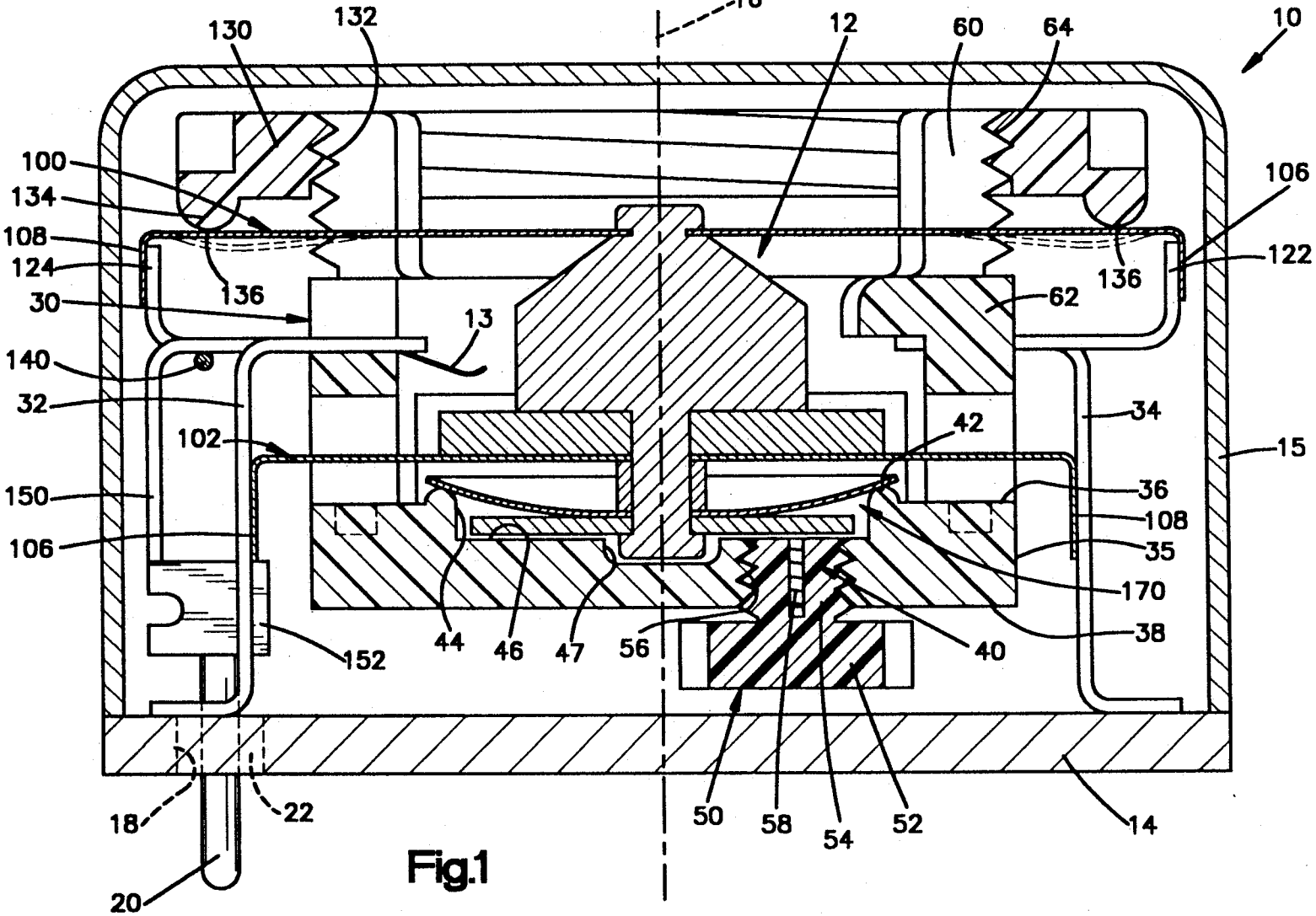
FIG. 1 is a sectional view of a gas damped deceleration switch in accordance with the present invention.

As shown in FIG. 1, the housing 10 comprises a chassis 14 and a cap 15, and has a central axis 16. The chassis 14 is a circular metal piece having a surface 18 defining an aperture. The cap 15 is a cylindrical metal piece welded onto the chassis 14. An electrical current carrying pin 20 protrudes outwardly through the aperture defined by the surface 18. A glass seal 22 in the aperture hermetically seals the housing 10 and insulates the pin 20 from the chassis 14. The pin 20 and the housing 10 serve as electrical terminals for the deceleration switch.

A base structure includes a plastic molded base 30, and a pair of folded sheet metal support pieces 32 and 34. The support pieces 32 and 34 have forward ends embedded in the base 30, and have rear ends welded to the chassis 14. The base 30 comprises a base platform 35 having a forward surface 36, a rear surface 38, and a passageway 40 communicating the forward surface 36 with the rear surface 38. The forward surface 36 includes a raised circular rim 42 coaxial with the axis 16 of the housing 10, a cylindrical surface 44 coaxial with the rim 42, and a bottom surface 46. The bottom surface 46 extends transversely to the axis 16 and defines a recess 47. The rim 42, the cylindrical surface 44, and the bottom surface 46 define a cup shaped portion of the base platform 35.

A plastic damping valve 50 has a handle portion 52 and a threaded portion 54. The threaded portion 54 is engaged with threads 56 in the base passageway 40, and includes an axially extending slot 58.

The base 30 further comprises a forward portion 60, and a middle portion 62 axially between the forward portion 60 and the base platform 35. The forward portion 60 of the base 30 has external threads 64 which are coaxial with the axis 16 of the housing 10.

Figure 4:
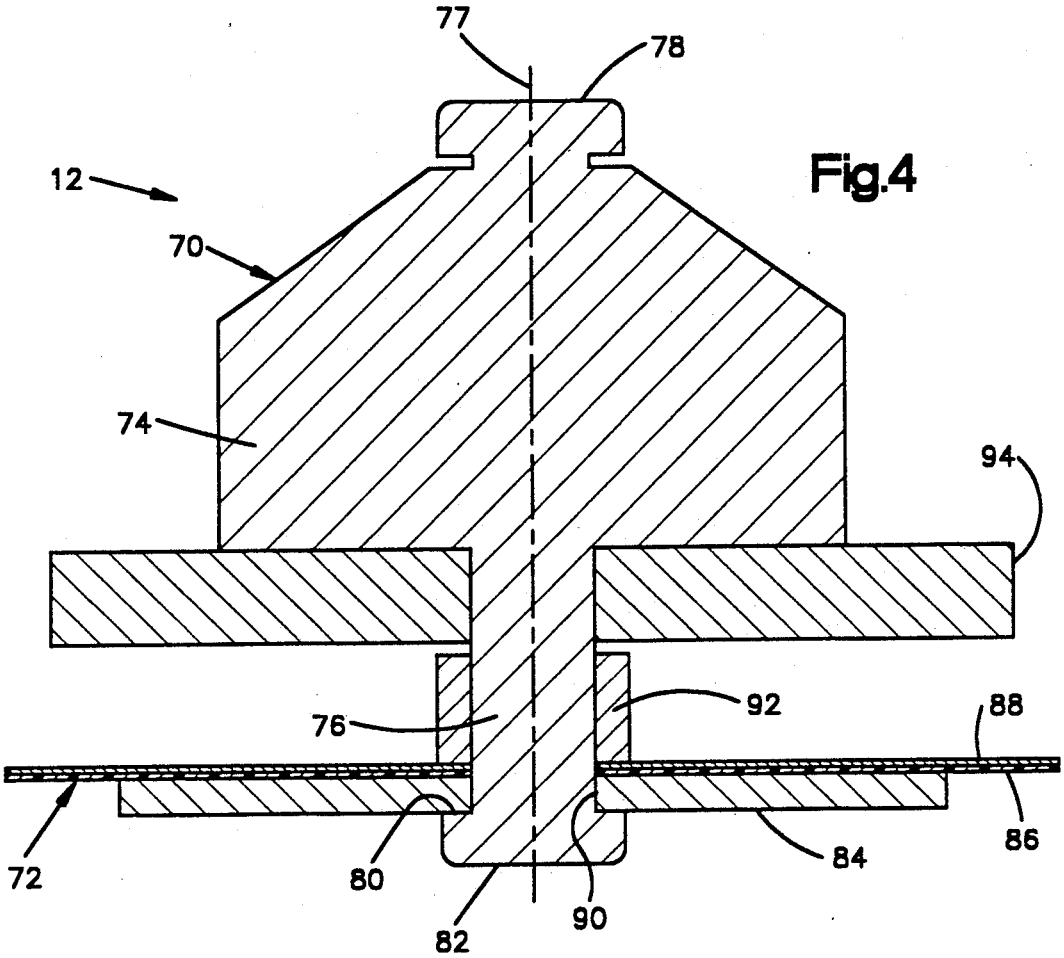
FIG. 4 is a sectional view of a component of the deceleration switch of FIG. 1.

As shown in FIG. 4, the mass assembly 12 comprises a mass 70 and a damping disk assembly 72. The mass 70 is formed of brass and comprises a major portion 74, a stem 76 extending rearwardly from the major portion 74, and a central axis 77. The major portion 74 has a front end 78 which defines the front end of the mass assembly 12. The stem 76 has an annular shoulder surface 80, and a rear end 82 which defines the rear end of the mass assembly 12.

The damping disk assembly 72 comprises a rigid metal separator disk 84, a flexible damping disk 86, and a damping disk spring 88. The damping disk assembly 72 has a cylindrical surface 90 defining a circular central opening, and is closely received coaxially over the stem 76 of the mass 70. A brass spacer sleeve 92 on the stem 76 holds the damping disk assembly 72 firmly in place against the shoulder surface 80 on the stem 76.

The damping disk assembly 72 can be formed in accordance with the invention set forth in copending U.S. patent application Ser. No. 664,499, Filed Mar. 5, 1991, entitled "Gas Damped Deceleration Switch" and assigned to the present assignee, which is a continuation of U.S. patent application Ser. No. 491,110, Filed Mar. 9, 1990, now abandoned.

The mass assembly 12 further comprises a brass contact disk 94 coaxially received over the stem 76. The contact disk 94 extends radially beyond the major portion 74 of the mass 70 as shown in the figures. The entire mass assembly 12 has a center of mass on the central axis 77 at a location between the stem 76 and the front end 78 of the mass 70.

Figure 5A:
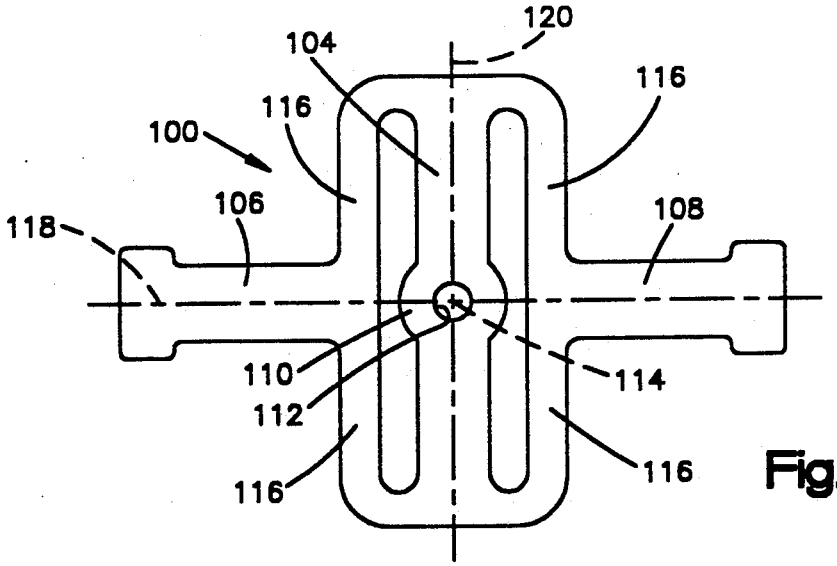
FIGS. 5*a* and 5*b* and top plan views of parts of the deceleration switch of FIG. 1.
Figure 5B:
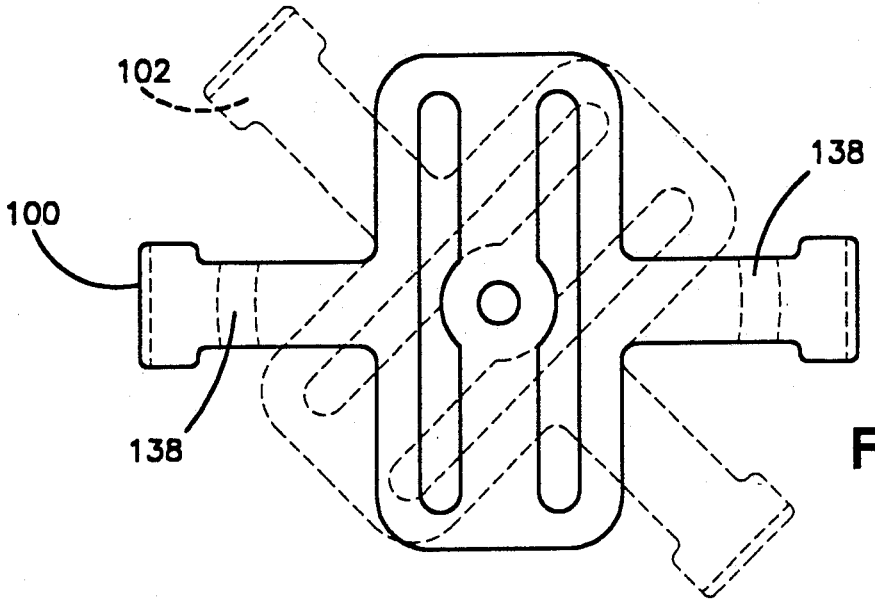

The deceleration switch also includes a front spring 100 and a rear spring 102 for supporting the mass assembly 12. As shown in FIGS. 1, 5A and 5B, the front and rear springs 100 and 102 each comprise an inner arm 104, and a pair of outer arms 106 and 108 perpendicular to the inner arm 104. An inner arm 104 includes a circular central region 110, and a circular opening 112 centered on an axis 114. Four connecting arms 116 which are parallel to the inner arm 104 connect the inner arm 104 to the outer arms 106 and 108. The front and rear springs 100 and 102 are symmetrical about perpendicular lines 118 and 120 intersecting at the axis 114.

As shown in FIG. 1, one outer arm 106 of the rear spring 102 is welded to the first sheet metal support piece 32 supporting the base 30, and the other outer arm 108 of the rear spring 102 is welded to the second sheet metal support piece 34. The sheet metal support pieces 32 and 34 support the rear spring 102 in a position coaxial with the housing 10. The outer arms 106 and 108 of the front spring 100 are welded to third and fourth sheet metal support pieces 122 and 124, respectively. The third and fourth sheet metal support pieces 122 and 124 to which the front spring 100 is welded are embedded in the middle portion 62 of the base 30, and project radially from the base 30 at positions which are circumferentially offset by approximately 45° from the positions where the first and second sheet metal support pieces 32 and 34 project radially from the base 30. The front and rear springs 100 and 102 are thereby supported on the base 30 to be coaxial and circumferentially offset relative to one another as indicated in FIG. 5B. Alternately, spiral springs could be used in place of the rectangular springs 100 and 102.

The mass assembly 12 is supported in the housing 10 by the front and rear springs 100 and 102 as shown in FIG. 1. The stem 76 of the mass 70 is closely received coaxially within the central opening 112 of the rear spring 102. The spacer sleeve 92 and the contact disk 94 firmly clamp the rear spring 102 to the mass assembly 12 at the circular central region 110 of the rear spring 102. The major portion 74 of the mass 70 extends through the central opening 112 of the front spring 100, and is firmly crimped onto the circular central region 110 of the front spring 100. The mass assembly 12 is movable axially forward in the housing 10 against the force of the springs 100 and 102 from the rest position shown in FIG. 1 to the actuated position shown in FIG. 3. When the mass assembly 12 is in the actuated position, the contact disk 94 touches the electrical contact 13. The mass assembly 12 is urged to move axially back from the actuated position toward the rest position by the bias of the front and rear springs 100 and 102. Since the various arms of each one of the springs 100 and 102 are symmetrical with respect to the axis 16, the axial forces exerted individually by each of the various spring arms are balanced with respect to the axis 16. The springs 100 and 102 therefore urge the mass assembly 12 to move only in axial alignment with the axis 16. The circumferentially offset positions of the front and rear springs 100 and 102 also serve to hold the mass assembly 12 in a position centered on the axis 16, because each of the springs 100 and 102 resists transverse movement of the mass assembly 12 in radial directions parallel to the various spring arms.

A plastic preload ring 130 has internal threads 132 and a circular rim 134. The circular rim 134 has an annular rim surface 136 The internal threads 132 on the preload ring 130 are engaged with the external threads 64 on the forward portion 60 of the base 30 so that rotation of the preload ring 130 relative to the base 30 moves the preload ring 130 axially relative to the base 30. As shown in FIG. 1, the annular rim surface 136 is coaxial with the axis 16 of the housing 10, and is in contact with the front spring 100. The annular rim surface 136 thereby defines surface areas 138 (FIG. 5B) on the outer arms 106 and 108 of the front spring 100 which are symmetrical and diametrically opposed with respect to the axis 16, and which are engaged by corresponding contact surface portions of the annular rim surface 136.

Figure 6:
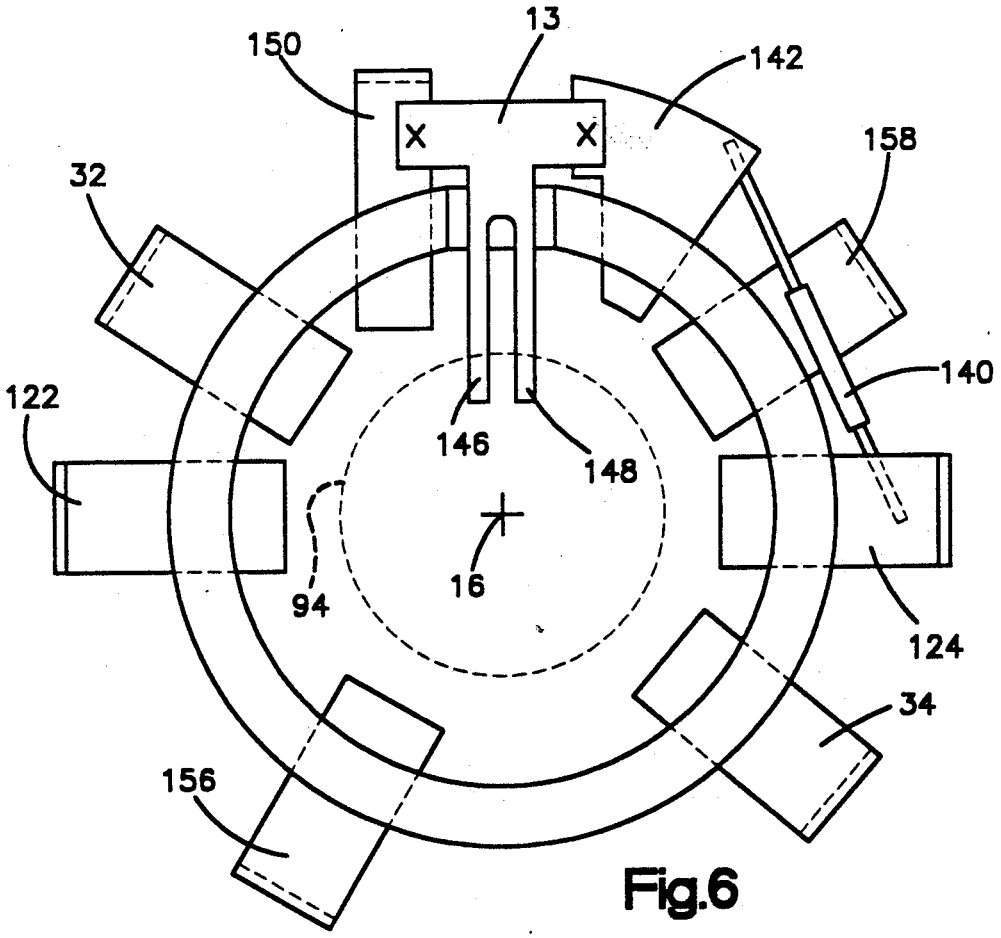
FIG. 6 is a view top plan of a portion of the deceleration switch of FIG. 1.

As shown in FIGS. 1 and 6, the deceleration switch further includes electrically conductive components defining a diagnostic circuit and a firing circuit through the deceleration switch. An electrical resistor 140 extends from the fourth sheet metal support piece 124 to a fifth sheet metal support piece 142. The fifth sheet metal support piece 142 is partially embedded in the middle portion 62 of the base 30, and extends circumferentially from the resistor 140 to the electrical contact 13. The electrical contact 13 extends radially through an opening in the middle portion 62 of the base 30 to a position radially inward of the outer edge of the contact disk 94 on the mass assembly 12. The radially inner end portion of the electrical contact 13 includes a pair of parallel, spaced apart contact arms 146 and 148. The electrical contact 13 extends circumferentially from the fifth sheet metal support piece 142 to a sixth sheet metal support piece 150. The sixth sheet metal piece 150 is similarly embedded in the base 30, and extends from the electrical contact 13 to a pin connector 152 at the inner end of the electrical current carrying pin 20.

The six sheet metal support pieces 32, 34, 122, 124, 142 and 150 embedded in the base 30 are originally formed as spoke-like projections on a single sheet metal piece. The plastic molded base 30 is formed around the single sheet metal piece, and a central portion of the single sheet metal piece is then cut out to separate the spoke-like projections from one another. The separate spoke-like projections are then folded as shown in the figures to define the first through sixth sheet metal support pieces 32, 34, 122, 124, 142 and 150. Also shown in FIG. 6 is a pair of supplemental sheet metal support pieces 156 and 158 which are similarly formed from spoke-like projections on the single sheet metal piece. The supplemental sheet metal support pieces 156 and 158 support the base 30 on the chassis 13 but do not carry electrical current.

The diagnostic circuit follows a path extending from the chassis 14 through the first sheet metal support piece 32 to the rear spring 102, and from the rear spring 102 through the mass assembly 12 to the front spring 100. The diagnostic circuit continues through the front spring 100 to the fourth sheet metal support piece 124, from the fourth sheet metal support piece 124 through the resistor 140 to the fifth sheet metal support piece 142, and further from the fifth sheet metal support piece 142 to the electrical contact 13. The diagnostic circuit then continues through the electrical contact 13 to the sixth sheet metal support piece 150, and onward to the pin connector 152 and the pin 20. A diagnostic test current, when applied between the chassis 14 and the pin 20 through the diagnostic circuit, is at a level below that which would activate the passenger safety device associated with the deceleration switch, as is known.

Figure 3:
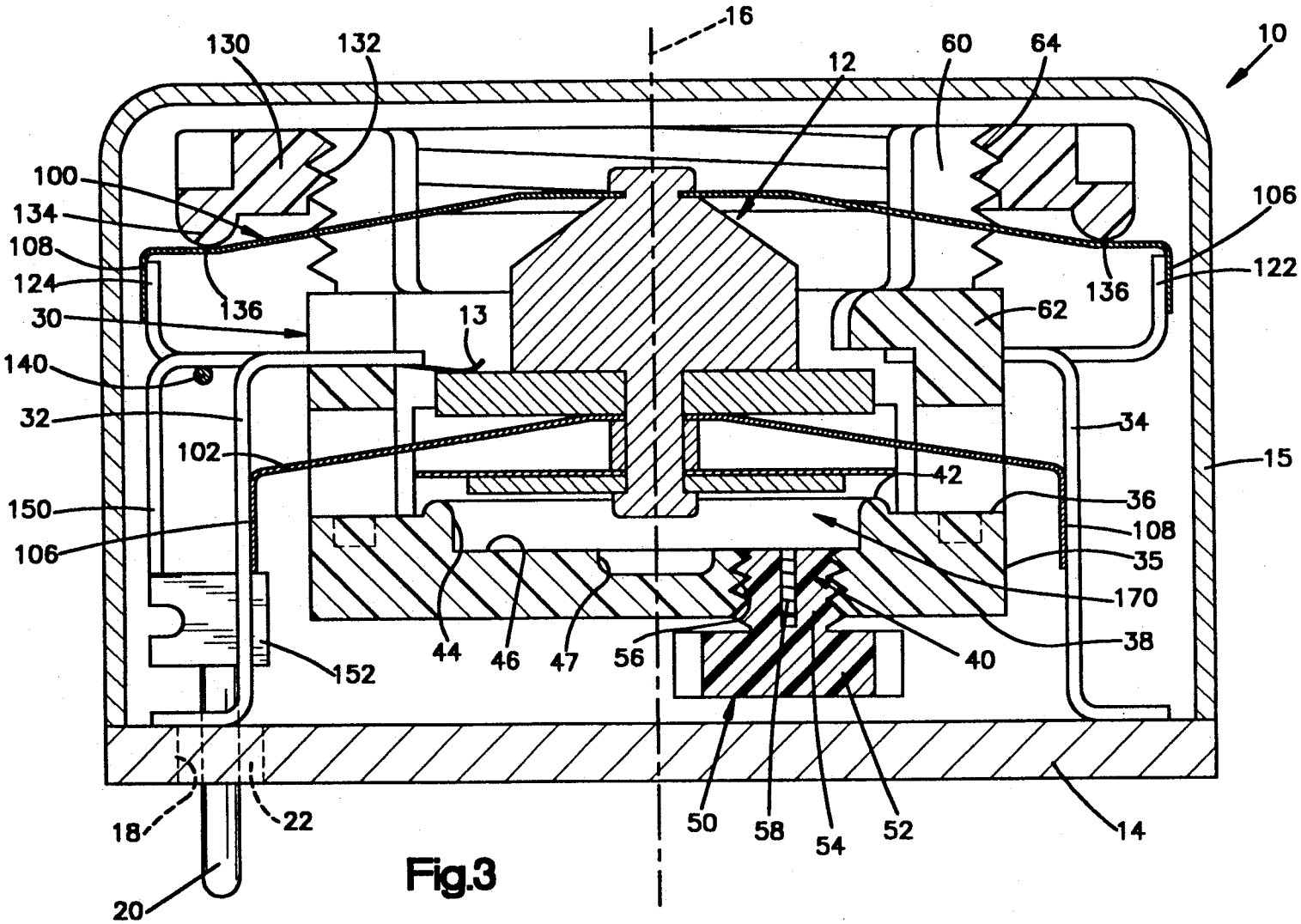

When the mass assembly 12 is in the actuated position with the contact disk 94 touching the electrical contact 13 as shown in FIG. 3, the firing circuit is closed. The firing circuit follows the path of the diagnostic circuit from the chassis 14 to the contact disk 94 in the mass assembly 12, and continues from the contact disk 94 directly to the electrical contact 13 to bypass the resistor 140. The firing circuit further continues from the electrical contact 13 through the sixth sheet metal support piece 150 to the pin connector 152 and the pin 20. The firing current, when applied between the chassis 14 and the pin 20 and bypassing the resistor 140 through the firing circuit, is at an elevated level which is sufficient to activate the passenger safety device.

Operation

The deceleration switch in accordance with the invention operates to activate a vehicle occupant safety device in response to a decelerating crash pulse experienced by a vehicle carrying the deceleration switch. Deceleration of the vehicle will urge the mass assembly 12 to move inertially away from the base 30. If a decelerating crash pulse has sufficient magnitude and duration, the mass assembly 12 will move axially forward from the rest position shown in FIG. 1, and will continue past the intermediate position shown in FIG. 2 to the actuated position shown in FIG. 3. When the mass assembly 12 reaches the actuated position, the contact disk 94 touches the electrical contact 13 to close the firing circuit which activates the vehicle occupant safety device in response to the decelerating crash pulse.

The mass assembly 12 is normally held in the rest position by the front and rear springs 100 and 102 as shown in FIG. 1. When the mass assembly 12 is in the rest position, the damping disk assembly 72 is in an initial position. The flexible damping disk 86 and the damping disk spring 88 are flexed relative to the rigid separator disk 84. The flexible damping disk 86 is held firmly against the rim 42 on the base platform 35 by the force of the damping disk spring 88. The flexible damping disk 86 thereby defines a space 170 between the flexible damping disk 86 and the cup shaped portion of the base platform 35, and provides a seal to block the flow of damping gas into the space 170 between the flexible damping disk 86 and the rim 42. An initial volume of the space 170 is defined by the flexible damping disk 86 when the damping disk assembly 72 is in the initial position.

Figure 2:
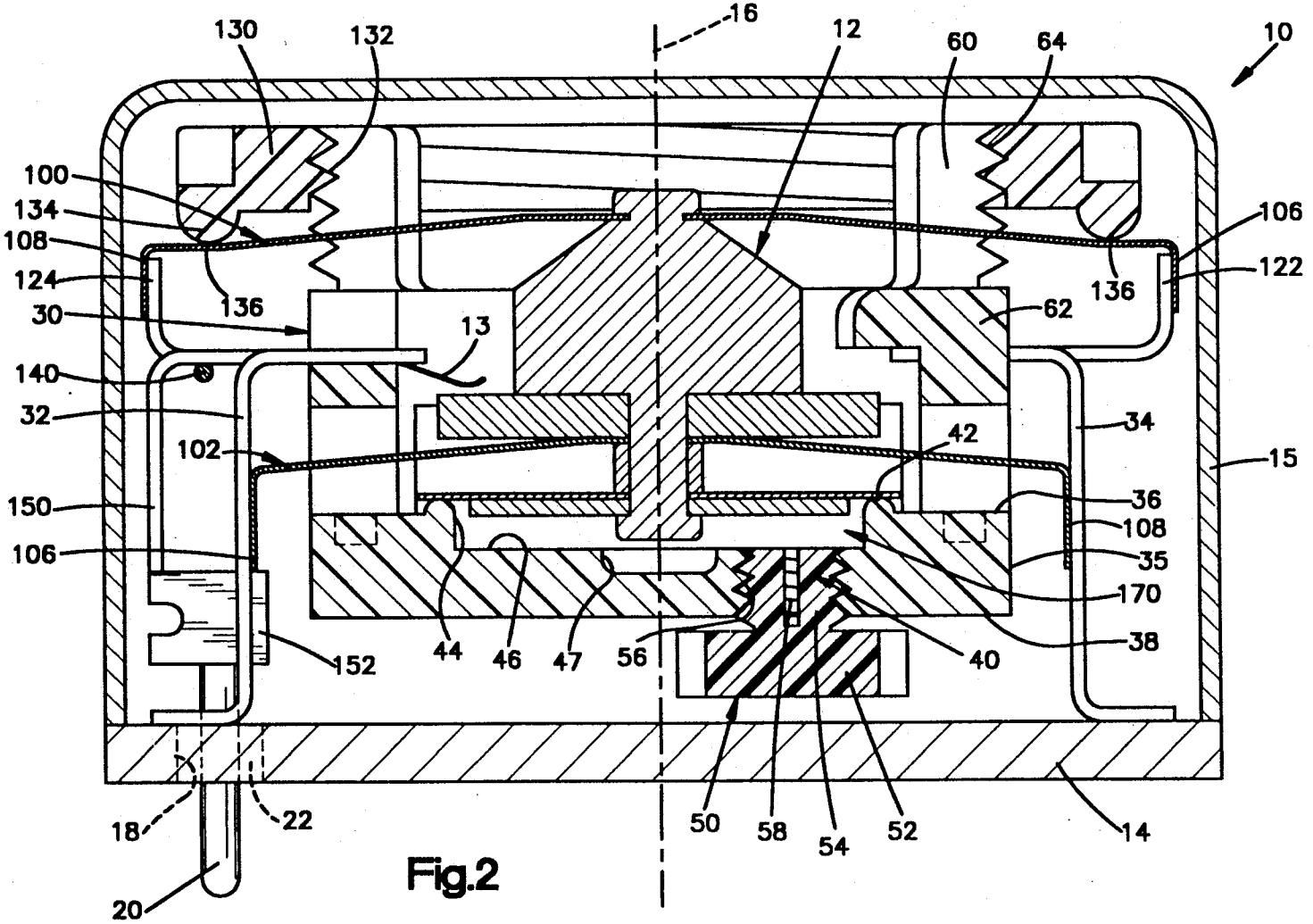
FIGS. 2 and 3 are sectional views of the deceleration switch of FIG. 1, illustrating parts in different positions.

When a decelerating crash pulse moves the mass assembly 12 from the rest position shown in FIG. 1 to the intermediate position shown in FIG. 2, the damping disk assembly 72 is carried with the moving mass 70 from the initial position shown in FIG. 1 to the advanced position shown in FIG. 2. When the damping disk assembly 72 is in the advanced position, the damping disk spring 88 still holds the flexible damping disk 86 firmly against the rim 42, but is resiliently flexed back toward a flat, unflexed condition. An enlarged volume of the space 170 greater than the initial volume of the space 170 is then defined by the flexible damping disk 86. Flexing of the damping disk spring 88 back toward its unflexed condition moves it axially relative to the rigid separator disk 84 such that the rigid separator disk 84 is moved into greater overlying surface contact with the flexible damping disk 86. Upon further axial movement of the mass assembly 12 beyond the position shown in FIG. 2, the rigid separator disk 84 will fully engage the rear surface of the flexible damping disk 86 and will move the flexible damping disk 86 out of engagement with the rim 42.

Damping gas contained within the housing 10 will exert a damping force against the forwardly moving front surface of the damping disk spring 88 when the mass assembly 12 moves forward from the rest position toward the actuated position. Forward movement of the damping disk assembly 72 increases the volume of the space 170 defined by the flexible damping disk 86. This increase in volume causes a decrease in the pressure of the damping gas contained within the space 170, and generates a vacuum (pressure reduction) in the space 170. Generation of a vacuum in the space 170 causes the damping gas in the housing 10 to exert an increased damping force against the forward surface of the moving damping disk spring 88.

The increased damping force caused by generation of a vacuum in the space 170 can be adjusted by the damping valve 50. A flow of gas is permitted into the vacuum through the passageway 40 extending through the base platform 35. Movement of the threaded portion 54 of the damping valve 50 axially into the passgeway 40 decreases the area of the gas flow path through the passageway 40 which is defined by the slot 58. The flow of gas permitted into the vacuum is thereby restricted. Movement of the threaded portion 54 of the damping valve 50 axially out of the passageway 40 increases the area of the gas flow path through the passageway 40 which is defined by the slot 58. The flow of gas permitted into the vacuum is thereby increased. The amount of gas flow permitted into the vacuum affects the degree to which a vacuum is generated by movement of the damping disk assembly 72. The degree to which the vacuum causes an increase in the damping force is thereby adjusted by the damping valve 50.

The bias exerted by the front spring 100 resisting forward axial movement of the mass assembly 12 is adjusted by the preload ring 130. If the preload ring 130 is rotated relative to the base 30 in one direction, the preload ring 130 will move axially toward the rear of the deceleration switch, or downwardly as shown in the figures. The annular rim surface 136 on the preload ring 130 will then move axially against the engaged surface areas 138 on the front spring 100, and the front spring 100 will be deflected from the flat position shown in solid lines in FIG. 1 to the deflected position shown in broken lines in FIG. 1. The front spring 100 will exert a greater force resisting forward axial movement of the mass assembly 12 when adjusted into a deflected position. Importantly, the annular rim surface 136 is coaxial with the front spring 100, so the engaged surface areas 138 on the front spring 100 are symmetrical with respect to the axis 16. Furthermore, the annular rim surface 136 moves equally in the axial direction against each of the engaged surface areas 138. The adjusting effect of the preload ring 130 on the front spring 100 is therefore uniformly distributed with respect to the axis 16. The forces exerted individually by the arms of the front spring 100 will therefore remain balanced about the axis 16 as the front spring 100 is adjusted by the preload ring 130.

If the preload ring 130 is rotated relative to the base 30 in an opposite direction, the preload ring 130 will move axially toward the front of the deceleration switch, or upwardly as shown in the figures. The annular rim surface 136 on the preload ring 130 will then permit the front spring 100 to flex back into a less deflected position. The front spring 100 will exert a lesser force resisting axial movement of the mass assembly 12 when in a less deflected position. The adjusted decreases in force exerted individually by the arms of the front spring 100 will also be balanced about the axis 16.

From the above description of a preferred embodiment of the invention, those skilled in the art will perceive improvements, changes and modifications. Such improvements, changes and modifications are intended to be covered by the appended claims.

Having described the invention, the following is claimed:

1. A deceleration sensor comprising:

a movable mass having an axis;

spring means for supporting said mass for inertial movement along said axis in response to deceleration, and for resisting movement of said mass along said axis, said spring means comprising spring members having surface areas in positions which are symmetrical with respect to said axis;

sensing means for sensing a predetermined amount of said movement of said mass to indicate a predetermined amount of deceleration over a time interval;

an adjustable member having contact surfaces engaged with said surface areas of said spring members; and means for supporting said adjustable member for movement along said axis to move each of said contact surfaces equally against each respective surface area of said spring members.

2. A deceleration sensor as defined in claim 1 wherein said adjustable member is a ring having a circular rim surface extending circumferentially about said axis, and said contact surfaces are circumferentially spaced portions of said rim surface.

3. A deceleration sensor as defined in claim 2 further comprising a base at a position fixed relative to said mass, said base having threads extending circumferentially about said axis, said ring having threads engaged with said threads on said base for rotation of said ring relative to said base to move said ring along said axis.

4. A deceleration sensor as defined in claim 3 wherein said spring means comprises a flat spring, said spring members are arms of said flat spring extending radially from said axis, and said positions of said surface areas of said spring members are diametrically opposed relative to said axis.

5. A deceleration sensor as defined in claim 4 wherein said spring means further comprises a second flat spring having arms extending radially with respect to said axis in positions circumferentially offset from said spring members having said surface areas.

6. A deceleration sensor as defined in claim 5 wherein said flat springs extend in planes which are parallel and axially spaced from each other.

7. A deceleration sensor as defined in claim 2 wherein said rim surface is a continuous circular surface.

8. A deceleration sensor as defined in claim 7 wherein said rim surface extends in a plane perpendicular to said axis.

9. A deceleration sensor as defined in claim 8 wherein said rim surface is centered on said axis.

10. A deceleration sensor as defined in claim 1 wherein said sensing means comprises means for defining an electrical current path, and means for enabling electric current to flow along said current path in response to said predetermined amount of said movement of said mass.

11. A deceleration sensor comprising:

a housing having an axis;

a movable mass assembly comprising a mass and a damping member connected to said mass;

supporting means for supporting said mass assembly for inertial movement along said axis in response to deceleration;

sensing means for sensing a predetermined amount of said movement of said mass assembly to indicate a predetermined amount of deceleration over a time interval; and said supporting means comprising spring means for resisting said movement of said mass assembly along said axis, said spring means comprising first and second springs each having a connection to said housing and a connection to said mass assembly, said springs resisting movement of said mass assembly radially relative to said axis during said movement of said mass assembly along said axis.

12. A deceleration sensor as defined in claim 11 wherein said connections of said springs to said mass assembly are spaced apart axially on said mass assembly.

13. A deceleration sensor as defined in claim 12 wherein said mass assembly has a first axial end, a second axial end, and a center of mass between said ends, and said connections of said springs to said mass assembly are on opposite axial sides of said center of mass.

14. A deceleration sensor as defined in claim 13 wherein said springs are flat springs extending radially from said mass assembly, each of said springs having a pair of parallel arms, said arms of one of said springs being circumferentially offset from said arms of the other of said springs.

15. A deceleration sensor as defined in claim 14 wherein said flat springs are sheet metal springs with arms perpendicular to said axis.

16. A deceleration sensor as defined in claim 15 comprising a base structure connected to said housing, said springs being connected to said housing through said base structure.

17. A deceleration sensor as defined in claim 11 wherein said sensing means comprises means for defining an electrical current path, and means for enabling electric current to flow along said current path in response to said predetermined amount of said movement of said mass assembly.

18. A deceleration sensor comprising:

an electrical contact element;

a movable mass assembly comprising a mass and a damping member connected to said mass;

a support structure supporting said electrical contact element;

means for supporting said mass assembly for inertial movement relative to said support structure in response to deceleration, and for supporting said mass assembly for inertial movement relative to said support structure into an actuated position in contact with said electrical contact element in response to a predetermined amount of deceleration, said supporting means comprising two electrically conductive springs each having a portion connected to said mass assembly for movement with said mass assembly, and each having a portion connected to said support structure;

said mass assembly, when either in or out of said actuated position, providing a conductive bridge between said two springs for electric current to flow in a first path extending through said two springs; and said mass assembly, when in said actuated position, providing a conductive bridge between one of said two springs and said electrical contact element for electric current to flow in a second path extending through said one spring and said electrical contact element.

19. A deceleration sensor as defined in claim 18 wherein said first electrical current path extends through said electrical contact element.

20. A deceleration sensor as defined in claim 19 wherein said first electrical current path extends through a resistor for limiting the current flow along said first path to a predetermined level below the level of current flow along said second path.

* * * * *

UNITED STATES PATENT AND TRADEMARK OFFICE

CERTIFICATE OF CORRECTION

PATENT NO. : 5,118,908

DATED : June 2, 1992

INVENTOR(S) : Robert J. Bolender

It is certified that error appears in the above-identified patent and that said Letters Patent is hereby corrected as shown below:

Column 10, Line 21, Claim 16, after 15 insert --further--.

Signed and Sealed this

Tenth Day of August, 1993

*Attest:*

*Attesting Officer*

Michael K. Kirk

MICHAEL K. KIRK

*Acting Commissioner of Patents and Trademarks*